United States Patent [19]

Pasternak et al.

[11] Patent Number: 4,637,111

[45] Date of Patent: Jan. 20, 1987

[54] PROCESS OF MAKING HEAT EXCHANGERS

[75] Inventors: Stephen F. Pasternak, Palm Harbor, Fla.; Franz X. Wohrstein, Chicago, Ill.

[73] Assignee: Peerless of America, Inc., Chicago, Ill.

[21] Appl. No.: 745,204

[22] Filed: Jun. 17, 1985

Related U.S. Application Data

[62] Division of Ser. No. 386,950, Jun. 10, 1982, Pat. No. 4,554,970.

[51] Int. Cl.[4] ..... B21D 53/02; B23P 15/26; F28F 1/20

[52] U.S. Cl. ..... 29/157.3 A; 29/157.3 B; 165/181

[58] Field of Search ..... 29/157.3, 157.3 A, 157.3 B; 165/181, 182, 146

[56] References Cited

U.S. PATENT DOCUMENTS

| | | | |
|---|---|---|---|
| 3,746,086 | 7/1973 | Pasternak | 29/157.3 B |
| 3,901,312 | 8/1975 | Pasternak | 29/157.3 A |
| 4,203,311 | 5/1980 | O'Connor et al. | 29/157.3 A |
| 4,330,913 | 5/1982 | Kritzer | 29/157.3 A |
| 4,332,069 | 6/1982 | Kritzer | 29/157.3 A |
| 4,349,949 | 9/1982 | Kritzer | 29/157.3 A |

*Primary Examiner*—Mark Rosenbaum
*Assistant Examiner*—Irene Graves Golabi
*Attorney, Agent, or Firm*—Emrich & Dithmar

[57] ABSTRACT

A heat exchanger having groups integral fins projecting outwardly from the sidewalls of the heat exchanger is manufactured by advancing a cutter into the sidewalls of the heat exchanger, turning the integral fins outwardly and severing predetermined fins with the cutting instrument to provide predetermined fin-free areas on the sidewalls.

8 Claims, 16 Drawing Figures

1
2
3
4
5
5a
5b
6
6a
6b
7
7a
8
8a
8b
9
10
11
12
13
13a
14
15
16
17
18
19
20
21
22
23
24
25
26
27
29
29a
A
B
C
D
E
F
G
H
P1
P2
P3
P4
P5
P6
P7
P8
P9
P10
P11
P12
P13
P14
P15
P16
P17
P19
P20
P21
P22

28
34
33
8
9
10
31
29
30
32
2
11
11a
29a
9
22
4
6
8
$P_{13}$
$P_{14}$
$P_{15}$

PROCESS OF MAKING HEAT EXCHANGERS

This is a division of application Ser. No. 386,950, filed June 10, 1982, now U.S. Pat. No. 4,554,970.

BACKGROUND OF THE INVENTION

The present invention relates to heat exchangers and the method of making the same, and more particularly, to heat exchangers of the type embodying outwardly projecting fins and the method of making the same.

Heat exchangers embodying fins formed from the outer surface material of tubular members have been heretofore known in the art, being disclosed, for example, in Richard W. Kritzer U.S. Pat. No. 3,202,212 and Joseph M. O'Connor U.S. Pat. No. 3,692,105, wherein, in the aforementioned Kritzer patent, the fins are formed in the form of spines formed from the outwardly projecting ribs on the tubular member; and in the aforementioned O'Connor patent, fins are formed by cutting our gouging them from such upwardly projecting ribs and the portion of the tubular member directly underlying the ribs, to thereby afford fins having elongated base portions projecting outwardly from the side wall of the tubular member, with spaced fins projecting outwardly from the outer longitudinal edges of the base portions.

Finned heat exchangers of the type such as that shown in the aforementioned Kritzer patent or the aforementioned O'Connor patent have often been made in substantial lengths, such as, for example, thirty, forty or fifty foot lengths. In such instances, it is normally necessary to support such heat exchangers at various intervals throughout their lengths, such as, for example, at six or eight foot intervals. Heretofore, this has meant that in order to afford relatively smooth, suitable supporting surfaces for engagement with the necessary supporting members, previously formed fins had to be removed at such intervals by suitable means, such as, for example, grinding, which required an additional, and completely separate operation after the complete forming of the heat exchanger. Such additional processes have proven detrimental to the widespread adoption and usage of such finned heat exchangers.

Also, in the manufacture of finned heat exchangers of the type disclosed in the aforementioned Kritzer patent and O'Connor patent, as well as in other patents such as, for example, Stephen F. Pasternak U.S. Pat. No. 3,886,639, Stephen F. Pasternak U.S. Pat. No. 3,901,312 and Joseph M. O'Connor U.S. Pat. No. 3,947,941, when it was desired to afford a heat exchanger having fin-free end portions for affording supporting member or connecting members, the common practice has been either to (1) form fins on a work-piece from one end thereof to a point at or beyond the desired length of the heat exchanger, then cut off the desired length of the heat exchanger and subsequently remove the fins on the desired intermediate portions and/or end portions of that length by suitable means, such as, for example, the aforementioned grinding; or (2) commence forming fins in inwardly spaced relation to the end of such a work-piece, form the fins for the desired length on the work-piece, and then sever the work-piece in outwardly spaced relation to such last formed fin, and then, if desired, remove fins from intermediate portions and/or reduce the size of the end portions of the work-piece by suitable means, such as, for example, grinding. Again, such method of forming finned heat exchangers require the use of grinding or other material-removing operations on the desired intermediate and/or end portions of the work-piece, which are additional to and completely separate from the fin-forming operations on the work-piece.

Additionally, in the manufacture of extended lengths of finned heat exchangers for use in steam cooling towers, which exchangers have openings therein are adapted to receive tubular steel piping inserts, difficulties are encountered because the finning process lengthens the exchanger thereby resulting in uneven heat exchange wall thickness about the steel piping inserts. Also, the separate process of removing by grinding the formed fins at predetermined intervals adds to the problem of uneven wall thickness about the piping insert. Accordingly, such problems have severely limited the adoption and usage of such finned heat exchangers.

SUMMARY OF THE INVENTION

It is a primary object of the present invention to afford a novel heat exchanger of the finned type, and a novel method of making such a heat exchanger.

It is another object of the present invention to afford a novel heat exchanger of the finned type, wherein the fins are constructed in a novel and expeditious manner.

Another object of the present invention is to afford a novel heat exchanger of the finned type, wherein previously formed fins are removed in a novel and expeditious manner as an integral part of the fin-forming operation on the heat exchanger.

Still another object of the present invention is to afford a novel heat exchanger of the finned type, wherein fin-free portions may be formed in a novel and expeditious manner at selected and predetermined positions along the entire length of the heat exchanger during the fin-forming operations on the heat exchanger.

A further object of the present invention is to afford a novel heat exchanger of the finned type, wherein the end portions of the heat exchanger may be formed in fin-free conditions as an integral part of the fin-forming operations on such a work-piece.

Another object of the present invention is to afford a novel heat exchanger of the finned type, wherein the end portions of the heat exchanger may be formed in various selected sizes in a novel and expeditious manner.

An object ancillary to the foregoing is to enable the end portions of such a heat exchanger to be formed in the aforementioned various selected sizes and an integral part of the fin-forming operations on the work-piece.

Another object of the present invention is to afford a novel heat exchanger of the finned type, which is adapted to receive steel piping inserts or the like which possess a uniform heat exchange wall thickness about the steel piping inserts, which is practical and efficient in operation, and which may be readily and economically produced commercially.

A further object is to afford a novel method for making such a finned heat exchanger.

Other and further objects of the present invention will be apparent from the following description and claims are are illustrated in the accompanying drawings which, by way of illustration, show the preferred embodiments of the present invention and the principles thereof, and what we now consider to be the best mode in which we have contemplated applying these principles. Other embodiments of the present invention embodying the same or equivalent principles may be used and structural changes may be made as desired by those skilled in the art without departing from the present invention and the purview of the appended claims.

DESCRIPTION OF THE DRAWINGS

FIG. 11 is a detail sectional view taken substantially along the line 11—11 in FIG. 1 showing the entire heat exchanger;

DETAILED DESCRIPTION OF THE INVENTION

Figures 1, 2:
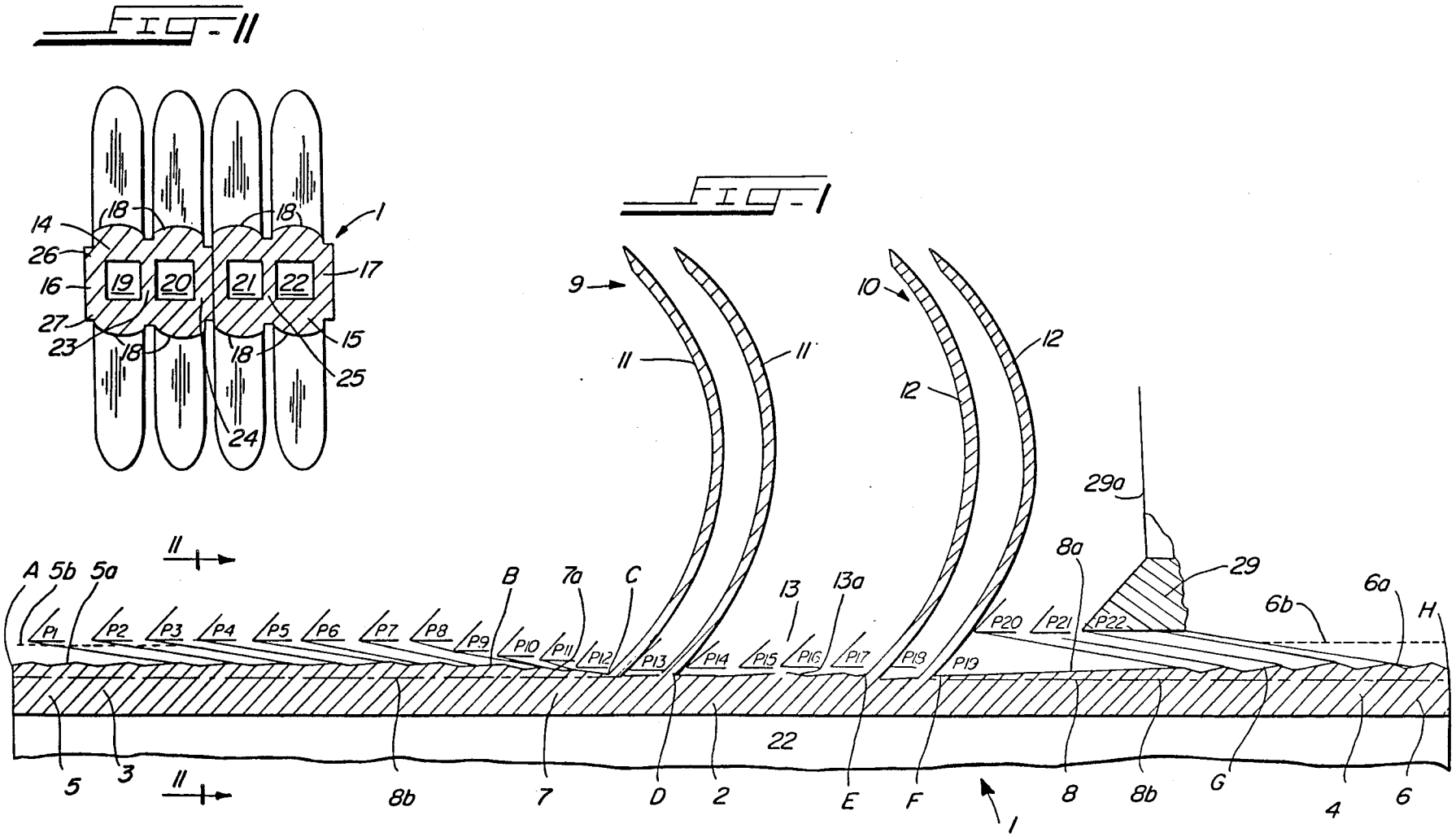
FIG. 1 is a diagrammatic, fragmentary longitudinal sectional view through a heat exchanger embodying the principles of the present invention, and illustrating the presently preferred method of making such a heat exchanger.
FIG. 2 is a diagrammatic, fragmentary sectional view through a heat exchanger of the type shown in FIG. 1, showing a cutter disposed in lowermost position for forming a fin of the heat exchanger.

A heat exchanger element or heat transfer element 1 is shown in FIGS. 1 and 11 of the drawings to illustrate the one embodiment of the present invention, and to illustrate the preferred method of making heat exchangers in accordance with the principles of the present invention.

As diagrammatically shown in FIG. 1, the heat exchanger 1 embodies an elongated tubular body member 2 having two oppositely disposed end portions 3 and 4, each having an outer portion 5 and 6, respectively, and an inner portion 7 and 8, respectively, with the inner portions 7 and 8 sloping inwardly from the outer portions 5 and 6, respectively, toward the longitudinal center line **8*b* of the tubular member 2. The heat exchanger 1 also embodies two finned areas 9 and 10, having a plurality of fins 11 and 12, respectively; with the finned areas 9 and 10 separated from each other longitudinally of the body portion 2 by a fin-free intermediate area 13**.

As will be discussed hereinafter in greater detail, in the preferred practice of one embodiment of the present invention, the heat exchanger element 1 is preferably formed from a suitable length of work-piece, in the form of tubular stock, such as the tubular member 2, which, as shown in FIG. 11, is substantially rectangular in transverse cross-section, embodying a top wall 14 and a bottom wall 15 disposed in substantially parallel relation to each other, and two oppositely disposed side walls 16 and 17 extending between respective side edges of the walls 14 and 15 in substantially perpendicular relation. In this embodiment of the present invention, the walls 14 and 15 have a plurality of parallel, longitudinally extending, ribs 18 projecting outwardly therefrom, for a purpose which will be discussed in greater detail hereinafter.

A plurality of openings 19, 20, 21 and 22, separated from each other by partition walls or panels 23, 24 and 25, respectively, extend longitudinally through the tubular member 2. As will be appreciated by those skilled in the art, the tubular member 2 is shown in FIGS. 1 and 2 as having a plurality of openings 19–22 extending therethrough merely by way of illustration and not by way of limitation, and tubular members having a single opening extending longitudinally therethrough may be afforded, without departing from the purview of the broader aspects of the present invention.

In the heat exchanger 1 shown in the drawings, the ribs 18 project outwardly from the outer faces of two body portions 26 and 27, FIG. 11, of the top wall 14 and the bottom wall 15, respectively.

The tubular member 2 from which the heat exchanger 1 is made, may be made of any suitable material, such as, for example, aluminum.

In the heat exchanger 1, shown in FIG. 1, the outer portion 5 of the end portion 3 extends from the end A of the body member 2 inwardly to a point B, and the inner portion 7 of the end portion 3 extends longitudinally of the body member 2 from the point B to a point C at the adjacent face of the bottom of the base of the closest adjacent fin 11; the finned area 9 extends from the point C longitudinally along the body member 2 to a point D disposed at the remote face of the bottom of the base portion of the fin 11 disposed most closely adjacent to the end portion 4; the intermediate portion 13 extends from the point D to a point E disposed at the adjacent face of the bottom of the base of the closest fin 12; the finned area 10 extends from the point E to a point F disposed at the remote face of the bottom of the base of the fin 12 disposed closest to the end portion 4; the inner portion 8 of the end portion 2 extends from the point F to a point G, defining the inner end of the outer portion 6 of the end portion 4; and the outer portion 6 of the end portion 4 extends from the point G to a point H at the end of the body portion 2 remote from the point A.

As will be appreciated by those skilled in the art, although areas 9 and 10 are shown in FIG. 1, as having only two fins 11 and 12, respectively, this is merely by way of illustration, and in actual practice, each such area would normally have a much greater number of fins, each area 9 and 10 oftentimes being in the nature of several feet in length and having several hundred fins 11 or 12, with each fin commonly being in the nature of two-thousandths to one-eighth of an inch in thickness.

As illustrated in FIG. 1, the upper surface **5*a* of the outer portion 5 of the end portion 3 as well as the upper surface 8*a* of the outer portion of the inner portion 8 and the upper surface 6*a* of the outer portion 6 of the end portion 4 appears to be somewhat roughened. This is by reason of the fact that in the formation of the heat exchanger 1, in accordance with the principles of the preferred embodiment of the present invention, the upper surfaces 5***a* and 6*a* of the outer portions 5 and 6 of the end portions 3 and 4, respectively, the fins are first formed on each of the upper surfaces and then sliced off or cut off at a distance above the base of the fins, as will be discussed in greater detail presently. However, it is within the scope of the present invention that the upper surface 5*b* (shown in dotted lines) of the outer portion 5 of the end portion 3, as well as the upper surface (not shown) of the outer portion 6 of the end portion 4 are substantially smooth. This is by reason of the fact that in the formation of the heat exchanger 1, the upper surfaces (only 5*b* is shown) of the outer portions 5 and 6, respectively, are untouched by the cutter, which forms fins 11 and 12, and the upper surface 8*a* of the inner portion 8 of the end portion 4 is so engaged by the cutter as to leave a substantially smooth surface.

Also, as illustrated in FIG. 1, the upper surface 7*a* of the inner portion 7 of the end portion 3 and the upper surface 13*a* of the intermediate portion 13 of the heat exchanger 1 is somewhat roughened. This is by reason of the fact that in forming the inner portion 7 of the outer end 3 of the heat exchanger 1, and in forming the intermediate portion 13 of the heat exchanger 1, fins are first formed on each of the upper surfaces thereof and then sliced or cut off at a distance above the base of the fins, as will be discussed in greater detail presently. However, it is to be remembered that the roughening shown in FIG. 1 is substantially exaggerated, so as to illustrate the same, and that, actually, in the preferred practice of the present invention, the fins are cut off so close to the base thereof that the roughening of the surface from which the stubs of the fins project is hardly susceptible to detection by feeling with a person's fingers. What has been heretofore stated with respect to the upper surfaces of the heat exchanger 1, shown in FIG. 1, also, of course, applies to the lower surfaces thereof, both such surfaces being simultaneously operated upon in the same manner in the formation of the heat exchanger 1, shown in FIG. 11, and only the upper surface of the heat exchanger 1 being shown in FIG. 1 for ease of illustration.

As will be appreciated by those skilled in the art, when a heat exchanger embodying fins of the nature of the fins 11 and 12, shown in FIG. 1, is made in accordance with the principles of the aforementioned patents, a suitable elongated work-piece, such as, for example, the aforementioned tubular member 2 is fed longitudinally through a suitable cutting machine, and, while the work-piece is so moving through the machine, the fins are cut or gouged from the upper and lower walls 14 and 15 of the tubular member 2 either from the e nd extremity of the leading end portion of the work-piece through the cutting machine or from inwardly spaced relation to such end extremity to the other end portion of the work-piece, by passing a cutter forwardly and inwardly along the path of movement of the work-piece along a path, such as the path from G to F in FIG. 1 to successively cut and stand upright a fin, such as the fins 11 and 12, at the forward end of each cutter stroke, for one end portion of the work-piece to the other. Thereafter, in such operation as heretofore known in the art, if fin-free areas, such as the intermediate area 13 or the inner portion 7 of the end portion 3 are desired, the fins previously formed on such areas must be removed by suitable means, such as, for example, grinding, in an additional and completely separate operation. This is not true in the preferred practice of the present invention.

In the preferred form of the practice of the present invention, the cutter of the cutting machine is reciprocated forwardly and rearwardly along cutting or gouging strokes, each of which is of the same length as the cutting strokes used to form fins of the same thickness and at the same spacing from each other as would have been used in the formation of fins in the manner disclosed in the aforementioned patents, during the continuous, uniform movement of the work-piece through the cutting machine. However, as will hereinafter be discussed in greater detail, in the practice of the present invention, when it is desired to form a fin-free area, such as, for example, A-B, the areas, B-C or the area D-E, the cutter is moved outwardly away from the tubular member 2 a short distance at the end of what would otherwise be a normal fin-forming stroke to thereby afford a fin-severing stroke wherein the cutter severs or cuts off the fin being formed, and lifts the fin away from the body of the tubular member 2.

Also, in the preferred from of the practice of the present invention, the raising and lowering of the cutter 29, relative to the work-piece passing through the cutting machine may be utilized to form end pieces of various desired lengths or diameters on the heat exchangers being formed, as will be discussed in greater detail presently.

Figures 2, 3, 4, 5, 6, 7, 8, 9, 10:
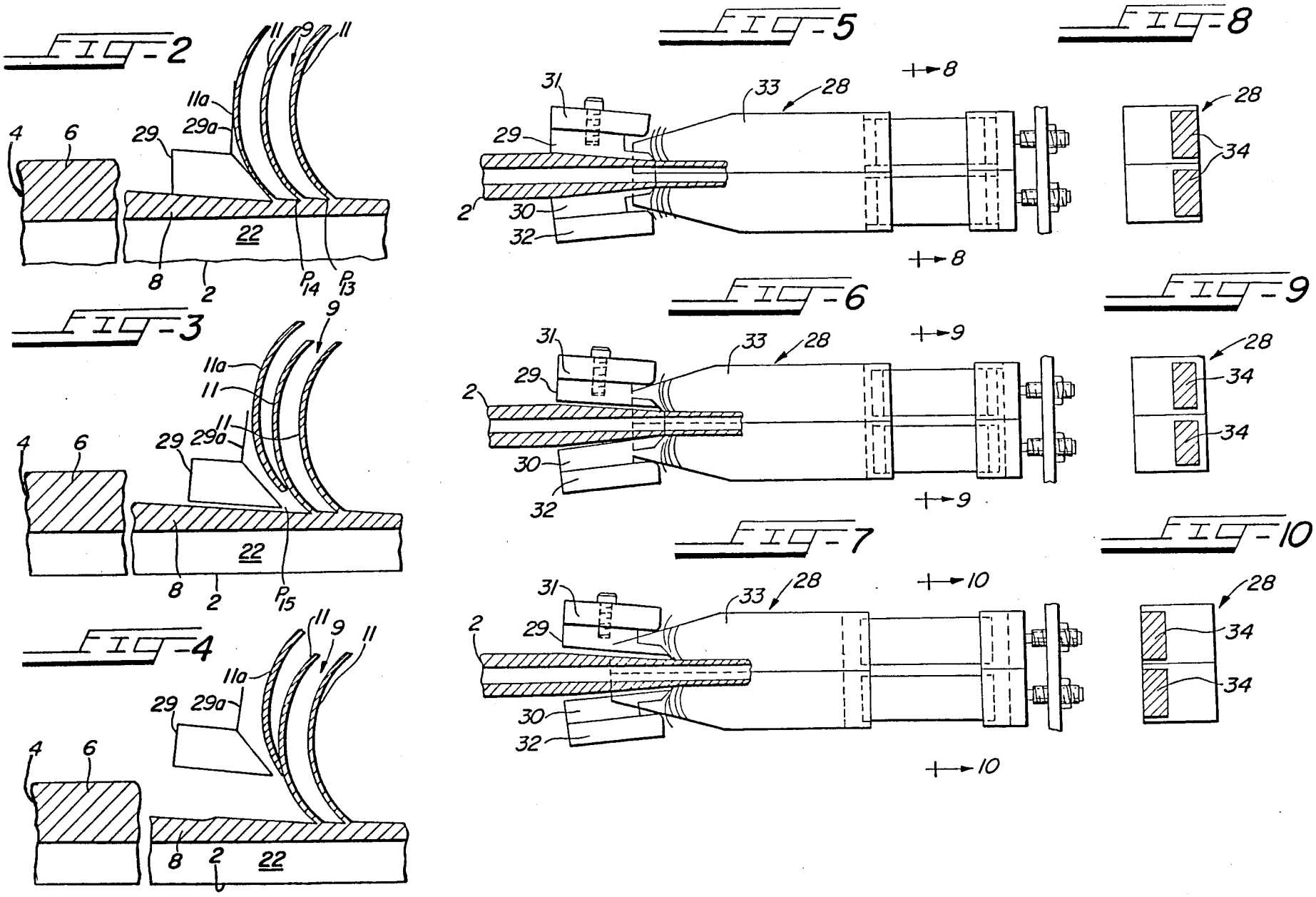
FIG. 3 is a view similar to FIG. 2 but showing the cutter disposed in an intermediate fin-severing, partially raised position.
FIG. 4 is a view similar to FIG. 2 but showing the cutter disposed in fully raised position.
FIGS. 5, 6 and 7 are diagrammatic views of a cutter mechanism, with the cutter disposed in positions corresponding to the positions of the cutters in FIGS. 2, 3 and 4, respectively.
FIGS. 8, 9 and 10 are diagrammatic sectional views taken substantially along the lines 8—8, 9—9 and 10—10 in FIGS. 5, 6 and 7, respectively.

In the preferred method of making a heat exchanger, such As the heat exchanger 1, shown in FIG. 1, in accordance with the principles of the present invention, a tubular member, such as the tubular member 2 is fed through a suitable cutting machine, such as the cutting machine 28, fragmentarily and diagrammatically shown in FIGS. 5–7, which embodies an upper cutter 29 and a lower cutter 30 to form the fins, such as the fins 11 and 12, on the upper and lower surfaces of the tubular member 2, respectively. The cutters 29 and 30 are mounted on respective lift cams 31 and 32 which are movable by an actuator 33 to all positions between a full inward or lowered position, as shown in FIGS. 2 and 5 and a full outward or fully raised position, as shown in FIGS. 4 and 7. In the operation of the cutting machine, actuator 33 is movable to the left, as viewed in FIGS. 5–7 by cams 34, FIGS. 8–10, to all positions from the positions shown in FIG. 5 to the position shown in FIG. 7 to move the cutters 29 and 30 away from each other to all positions from the aforementioned fully lowered position to the aforementioned fully raised position, and by movement of the actuator 33 to the right, to move the cams 29 and 30 to any predetermined position from the aforementioned fully raised position, shown in FIG. 7, to the fully lowered position shown in FIG. 5.

In the formation of the heat exchanger 1 in the cutting machine 28, the tubular member 2 continuously moves from left to right through the cutting machine 28, as viewed in FIGS. 5–7, which movement corresponds to a right to left movement, as viewed in FIG. 1.

It will be remembered that in the operation of the cutting machine 28, when fins are being formed, each of the cutters 29 and 30 reciprocate along paths of movement which are of the same length, with the path of movement of each cutter 29 and 30 during each successive fin-forming stroke being disposed in spaced, parallel relation to the earlier fin-forming strokes thereof. Similarly, as will be discussed in greater detail hereinafter, when the cutters 29 and 30 are moving through the aforementioned fin-severing strokes, they move through strokes which are of the same length and disposed parallel to the aforementioned cutting strokes, except that at the end of each severing stroke the cutter moves a short distance away from the tubular member 2 in the aforementioned outwardly fin-severing operation.

In FIG. 1, the extreme forward movement of the front end of the cutter bar 29 for each effective fin-forming or fin severing stroke, relative to the tubular member 2, is shown diagrammatically and indicated by the reference letters P-1 to P-22, inclusive.

When fins, such as the fins 11, are being formed in the machine 28, the cutter 29 moves through the aforementioned cutting stroke for a distance, and parallel to a predetermined line, such as the line between the point F and the point G, in FIG. 1, the cutter 29 stopping at its forwardmost position, such as the point P-13, with the cutter plate 29*a* engaging the fin 11 to position the same in upright position. During the next reciprocation of the cutter 29, the forwardmost movement of the cutter 29 stops at the point P-14 to thereby form the second fin 11 shown in FIG. 1.

Referring now to FIG. 2, during the next reciprocation of the cutter 29, the cutter 29 forms the fin 11*a*. However, this fin 11*a* has been formed at the beginning of the aforementioned intermediate area 13, which it is desired to have be fin-free at the completion of the forming of the heat exchanger 1. As a result, toward the end of the forward movement of the cutter 29, the cutter 29 is raised somewhat (preferably in the nature of three thousandths of an inch) from the tubular member 2, so that the fin 11*a* is severed from the tubular member 2, closely adjacent to the base of the fin 11*a*, at point P-15.

Thereafter, through the intermediate area 13, the cutter bar 29 is reciprocated through fin-severing strokes, as illustrated in FIG. 3, each of the severing strokes terminating at their forward ends at points P-16 to P-17, respectively, FIG. 1. This insures that the length of intermediate area 13 has a predetermined and uniform thickness 2*a* between the outside surface 13*a* and the opening 22.

When it is again desired to form fins, such as, for example, the fins 12, the cutter 29 is again reciprocated only through fin-forming cutting strokes, as illustrated in FIG. 2, the strokes ending at their forward ends at fin-forming positions, such as points P-18 and P-19, FIG. 1.

Then, if it is desired to leave the surface of the tubular member 2, from the point F to the point G fin-free and relatively smooth but in enlarged detail roughened, the cutter 29 may be gradually raised, during each reciprocation thereof, a sufficient distance that it will only engage the tubular member 2 partially during reciprocation of the cutter, but a distance insufficient to cause it to engage the rearwardmost fin 12, the cutter merely reciprocating through non-cutting reciprocations from the point P-20 to the fully raised position at P-21, at which latter time it is disposed in upwardly spaced relation to the ribs 18 on the top wall 14 at the end of each cutter stroke, so that from the point P-22 thereon, the tubular member 2 passes through the cutting machine 28 and is only partially engaged by the cutter bar 29, as shown by outer surface 6*a* of end 6 or point G to the end of tubular member 2 at point H.

However, if it is desired that the end outer surface 6*b* (shown by dotted line) from point G to point H is entirely smooth, then from point P-22 thereon, the tubular member 2 passes through the cutting machine 28 without being engaged by the cutter bar 29. This is true also for the opposite end 3 wherein the end outer surface 5*b* (shown by dotted line) extends from point A to point B (from point P-1 through P-9). In such a manner, it is possible to predeterminedly control the thickness and diameter of ends 3 and 4 as desired.

At the start of fin-forming operations in the machine 28, the operation of the cutter bar 29 is similar to that just described, but is somewhat in the reverse. That is, during the initial movement of the tubular member 2 through the machine 28, the cutter bar 29 is disposed either in the fully raised position from the point P-1 through the point P-9 or in a predetermined inward stroke position wherein a specific surface layered amount of the tubular member 2 is removed, as shown in FIG. 1. However, it will be remembered that from the point B to the point C in FIG. 1, it is desired to have the surface of the tubular member 2 fin-free and at substantially the same, but reversed angle, as that of the surface from the point F to the point G. To accomplish this, from the point P-10 through the point P-12, the cutter bar 29 is lowered in increments from the fully raised position shown in FIG. 4 toward the fully lowered position shown in FIG. 2. At each lowering, the cutter bar 29 is first reciprocated through a fin-severing stroke, the severing strokes terminating at their forward ends at points P-10 to P-12, inclusive. Thereafter, the cutter 29 is lowered to fully-lowered fin-forming position, so that it is effective, when it moves to point P-13 to form the first fin 11, as previously described.

From the foregoing it will be seen that with this novel method of forming a finned heat exchanger end portions, such as the ends 3 and 4, which are fin-free, and substantially smooth, may be formed as an integral part of the manufacture of a heat exchanger in a cutting machine, to afford connecting members and/or supporting members at each end of the finished heat exchanger. Also, it will be seen that in this same operation, finned areas of any desired length, such as the finned areas 9 and 10 may be predeterminedly and selectively formed during the manufacture of the heat exchanger and fin-free intermediate areas, such as the intermediate area 13, may also be readily selectively formed during the manufacture of the heat exchanger.

It will be appreciated by those skilled in the art that what has been heretofore stated with respect to the operation of cutter 29 also applies to the operation of cutter 30, the latter merely operating in the reverse, that is upwardly and inwardly from the bottom of the tubular member 2.

Also, it will be appreciated by those skilled in the art that any desired number of finned areas, such as the finned areas 9 and 10, and any desired number of the fin-free areas, such as the intermediate area 13, may be afforded, the areas 9, 10 and 13 merely being shown herein by way of illustration.

As may best be seen by reference to the points P-19 to P-21, shown in FIG. 1, this method of heat exchanger manufacture may also be utilized to form the end portions of such a heat exchanger 1, such as, for example, the end portions 3 and 4, into various desired diameters and/or lengths. Thus, for example, if it is desired that substantially no taper be afforded between the ends A and H of the tubular member 2 and the closest respective fins 11 and 12, the cutter 29 may be reciprocated through severing strokes, corresponding to the severing stroke terminating at point P-12 during the initial operations on the tubular member 2, prior to forming the fins 11, and the cutter 29 may be reciprocated through severing strokes at a level corresponding to the severing point P-19, to thereby form a substantially horizontally extending upper surface for the end portions 3 and 4 corresponding to the thickness of the tubular member 2 at the points P-12 and P-19, respectively.

This, it will be seen is true with respect to any other desired thickness, from the thickness at the aforementioned points P-12 and P-19 to the thickness at points B and G, respectively, it merely being necessary to reciprocate the cutter through fin-severing strokes at the desired distance away from the longitudinal center line of the tubular member 2.

Figure 12:
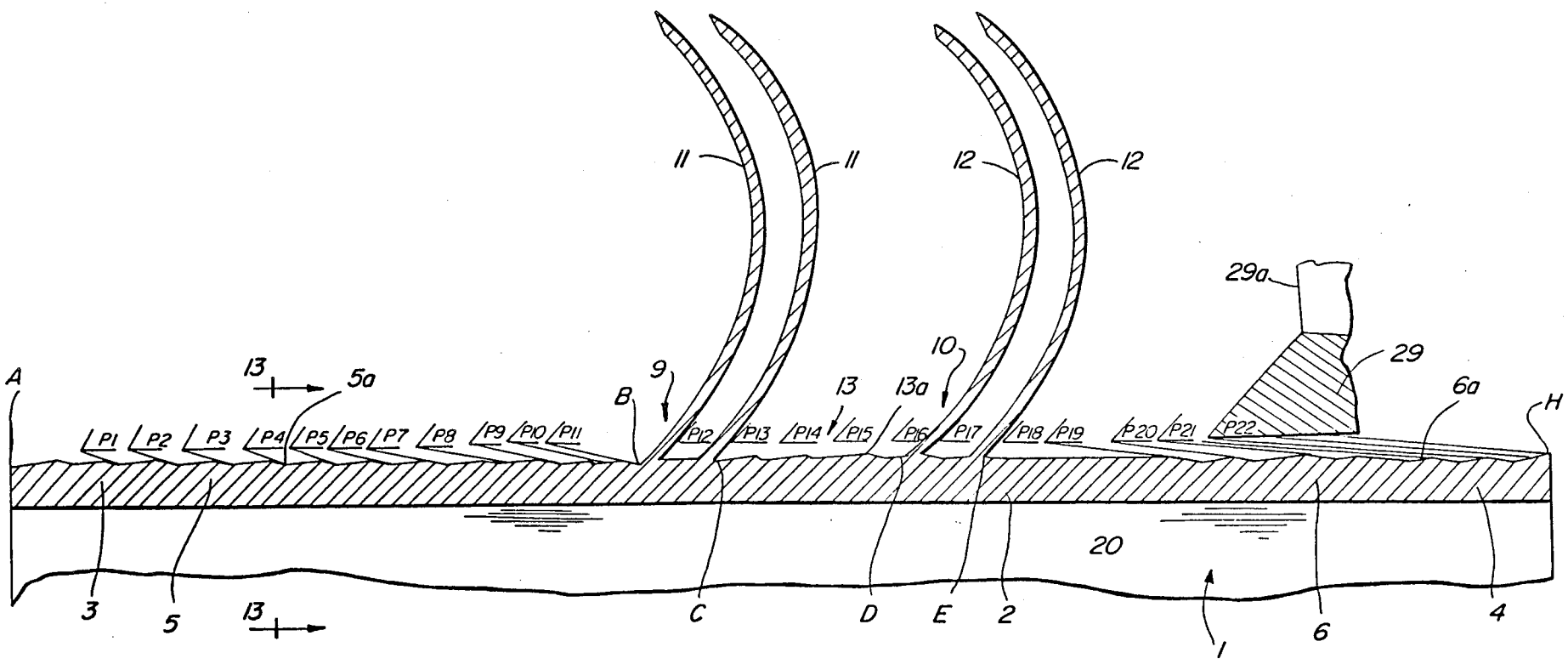
FIG. 12 is a diagrammatic, fragmentary longitudinal sectional view through a heat exchanger element adapted to receive a steel pipe therein in accordance with a further embodiment of the present invention and illustrating a preferred method of making such a heat exchanger.
Figure 13:
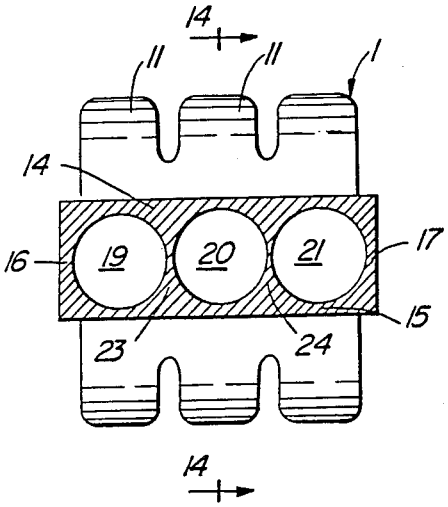
FIG. 13 is a detail sectional view taken substantially along the line 13—13 in FIG. 12 showing the entire heat exchanger element.

In a further embodiment of the present invention, as shown in FIGS. 12–16, a heat exchanger element 1 is formed from a suitable work-piece in the form of tubular stock or member 2. As shown in FIG. 13, the heat exchanger 1 is substantially rectangular in transverse cross-section, embodying a top wall 14 and a bottom wall 15 disposed in substantially parallel relation to each other, and two oppositely disposed side walls 16 and 17 extending between respective side edges of the walls 14 and 15 in substantially perpendicular relation.

Figure 15:
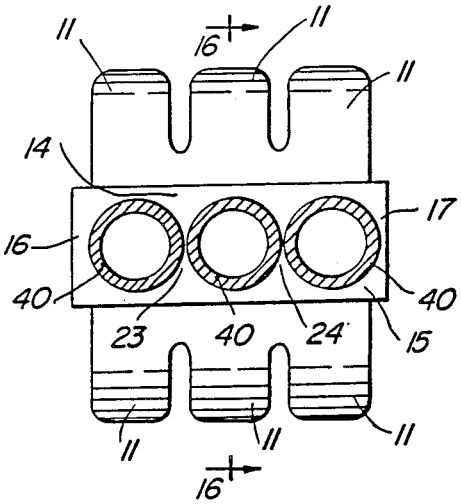
FIG. 15 is a detail sectional view taken substantially along line 15—15 in FIG. 16 showing the heat exchanger element and steel pipe inserts therein in accordance with the present invention.

A plurality of circular openings 19, 20 and 21 separated from each other by partition walls or panels 23 and 24, respectively, extend longitudinally through the tubular member 2. As will be appreciated by those skilled in the art, the tubular member 2 is shown in FIGS. 12, 13 and 15 as having a plurality of circular openings 19–21 extending therethrough merely by way of illustration and not by way of limitation, and tubular members having a single opening extending longitudinally therethrough may be afforded, without departing from the purview of the broader aspects of the present invention. Importantly, it is sufficient that each of the circular openings 19–21 are adapted to sealingly receive a steel tube, to complete the heat exchange assembly 1, as will hereinafter be described and shown in FIGS. 15 and 16.

In the heat exchanger 1, shown in FIG. 12, the outer portion 5 of the end portion 3 extends from the end A of the body member 2 inwardly to a point B at the adjacent face of the bottom of the base of the closest adajcent fin 11; the finned area 9 extends from the point B longitudinally along the body member 2 to a point C disposed at the remote face of the bottom of the base portion of the fin 11 disposed most closely adjacent to the end portion 4; the intermediate portion 13 extends from the point C to a point D disposed at the adjacent face of the bottom of the base of the closest fin 12; the finned area 10 extends from the point D to a point E disposed at the remote face of the bottom of the base of the fin 12 disposed closest to the end portion 4; and the outer portion 6 of the end portion 4 extends from the point E to a point H at the end of the body portion 2 remote from the point A.

Although areas 9 and 10 are shown, in FIG. 12, as having only two fins 11 and 12, respectively, this is merely by way of illustration, and in actual practice, each such area would normally have a much greater number of fins, each area 9 and 10 oftentimes being in the natuare of several feet in length and having several hundred fins 11 or 12, with each fin commonly being in the nature of two-thousandths to one-eighth of an inch in thickness.

Figure 14:
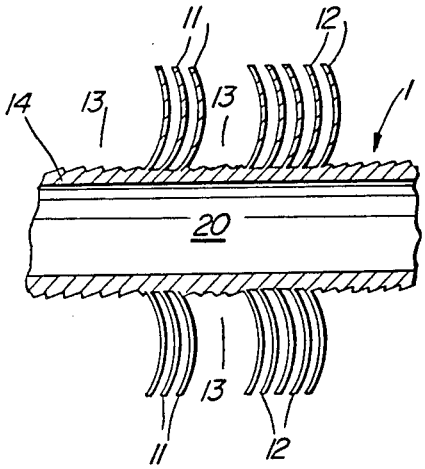
FIG. 14 is a diagrammatic longitudinal sectional view taken substantially along line 14—14 in FIG. 13.
Figure 16:
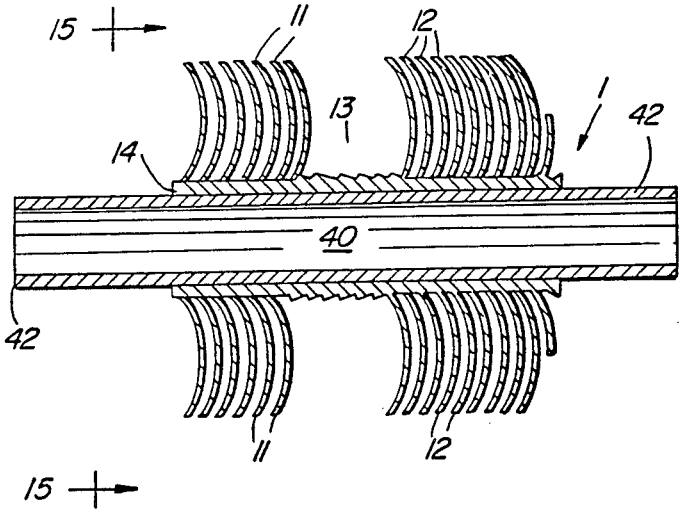
FIG. 16 is a diagrammatic longitudinal sectional view taken substantially along line 16—16 in FIG. 15.

As illustrated in FIG. 12 the upper surface 5*a* of the outer portion of the end portion 3 as well as the upper surface 13*a* between fins 11 and 12 and the upper surface 6*a* of the outer portion 6 appears to be somewhat roughened because fins are formed on each of these upper surfaces and then sliced off a predetermined distance above the plurality of circular openings 19, 20 and 21 as shown in FIGS. 13 and 15. The predetermined distance between the outer surfaces 5*a*, 13*a* and 6*a* and the openings in the extruded heat exchanger 1 are well adapted to receive steel piping inserts, as shown in FIGS. 15 and 16. The particular heat exchanger described has particular applicability to usage in steam cooling towers and permits the ends 42 of the steel pipes 40 to be mounted into headers in the cooling tower. The uniform depth or thickness side edges of the walls 14 and 15 as well as the disposed sidewalls 16 and 17 permit uniform cooling of the steam contained in the steel tubes 40, a result which has heretofore been unknown in the art. As shown in FIGS. 14 and 16, the heat exchanger 1 is adapted to have any number of predetermined areas 13 thereon which permit reinforcement of the elongated heat exchangers when mounted to the cooling tower structure.

In processing a tubular member 2, reference is made to FIG. 12 wherein the tubular member is inserted between the cutters 29, as previously discussed in FIGS. 2–10 and the cutter 29 is permitted to engage the tubular member to its predetermined cutting stroke to achieve the cutting cycle and insure that the outside surfaces 5*a*, 13*a* and 6*a* have a uniform and predetermined thickness between outside surfaces and the opening 20 therein .

In practice, it is desired that the actual outside extruded surface of the tubular member 2 is such that it is so dimensioned that a minimum amount of material is removed from the extruded tubular member to achieve the predetermined thickness from the outside surface to the circular opening 21. Commonly, the amount of material removed ranges from the nature of two thousandths to one-eigth of an inch in thickness, depending upon the thickness of each fin formed on the tubular member.

What has been described above is a novel heat exchanger of the fin type which is adapted to receive steel piping inserts which possess a uniform heat exchange wall thickness about steel piping inserts which is practical and efficient in operation and which is readily and economically produced commercially.

From the foregoing, it will be seen that the present invention affords a novel method of making finned heat exchangers.

In addition, it will be seen that the present invention affords a novel heat exchanger.

Thus, while we have illustrated and described the preferred embodiment of my invention, it is to be understood that this is capable of variation and modification, and we therefore do not wish to be limited to the precise details set forth, but desire to avail ourselves of such changes and alterations as fall within the purview of the following claims.

We claim:

1. The method of making a heat transfer element comprising:

a. forming an elongated tubular member having a wall portion and a longitudinal center line therein, b. successively, from one end portion of said tubular member toward the other end portion thereof,
(1) making cuts into said wall portion with a cutter means to thereby afford elongated fins extending across said tubular member in a direction transverse to the length thereof,
(2) turning said fins outwardly into outwardly projecting relation to said tubular member, and
c. predeterminedly severing with said cutter means certain of said fins from said wall prior to making the next successive cut into said wall to provide at least two groups of fins spaced from each other longitudinally along said wall portion with the spacing therebetween formed by the severed fins stubs having substantially a horizontal outer plane surface with signed to the longitudinal center line of said tubular member.

2. The method of making a heat transfer element comprising
a. forming an elongated tubular member having a longitudinal center line therein and top and bottoms wall portions thereon,
b. successively, from one end portion of said tubular member toward the other end portion thereof,
(1) making cuts into said top and bottom wall portions with a cutter means thereby providing elongated fins extending across said tubular member in a direction transverse to the length thereof,
(2) turning said fins longitudinally outwardly into projecting relation to said tubular member wherein said fins are convexly curved toward said other end portion, and
c. predeterminedly severing with said cutting means certain of said fins from said top and bottom wall portions at the end of making the cut forming each respective one of said last mentioned fins to provide at least two groups of fins spaced from each other longitudinally along both of said top and bottom walls, with the spacing therebetween formed by the severed fins stubs having substantially an outer horizontal plane surface with respect to the longitudinal center line of the tubular member.

3. The method defined in claim 2, and in which
a. said tubular member is longitudinally moving in a direction toward said one end portion at all times.

4. The method defined in claim 3, and in which
a. said fins are severed by cutting outwardly away from said wall portion.

5. The method defined in claim 1 further including the steps of positioning a tubular steel pipe in sealingly relationship in said tubular member to complete the heat transfer element.

6. The method defined in claim 3, and which includes
a. reducing the outer diameter size of the end portions of said tubular member extending outwardly of said upwardly turned fins by making successive cuts into said end wall portions at a uniform distance from the longitudinal center line of said tubular member and predeterminedly severing with said cutting means the upwardly turned fins at the end of making the cut.

7. The method defined in claim 3, and which includes
a. forming end portions at opposite ends of said tubular member, each of which end portions has an outer portion, the outer surface of which is substantially parallel to the center line of said tubular member, and an inner portion, the outer surface of which slopes inwardly from said outer portion of the respective end portion toward said center line, by
(1) failing to make said cuts on said outer portions and the trailing one of said inner portions, and
(2) making said fin-severing cuts, at progressively shorter distances away from said center line, along the leading one of said inner portions.

8. The method defined in claim 3, and which includes
a. forming end portions at opposite ends of said tubular member, each of which end portions has sn outer portion, which is of reduced thickness and the outer surface of which is substantially parallel to the center line of said tubular member, and an inner portion, the outer surface of which slopes inwardly from said outer portion of the respective end portion toward said center line, by
(1) making said fin-severing cuts on said outer portions at a uniform distance from said center line,
(2) making said fin-severing cuts, at progressively shorter distances away from said center line, along the leading one of said inner portions, and
(3) failing to make said fin forming cuts and said fin-severing cuts on the trailing one of said inner portions.

* * * * *